US008979141B2

(12) United States Patent
Lee

(10) Patent No.: US 8,979,141 B2
(45) Date of Patent: Mar. 17, 2015

(54) DOOR OF WASHING MACHINE AND ASSEMBLING STRUCTURE AND ASSEMBLING METHOD THEREOF

(75) Inventor: Sang Bin Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 564 days.

(21) Appl. No.: 12/461,018

(22) Filed: Jul. 29, 2009

(65) Prior Publication Data

US 2010/0115848 A1 May 13, 2010

(30) Foreign Application Priority Data

Nov. 10, 2008 (KR) ..... 10-2008-110754

(51) Int. Cl.
*E05C 19/10* (2006.01)
*D06F 39/14* (2006.01)
*E05C 3/16* (2006.01)

(52) U.S. Cl.
CPC ..... *D06F 39/14* (2013.01); *Y10S 292/69* (2013.01)
USPC ..... 292/126; 292/95; 292/121; 292/128; 292/226; 292/228; 292/DIG. 69

(58) Field of Classification Search
CPC ..... D06F 37/42; D06F 39/14; E05C 3/00; E05C 3/006; E05C 3/008; E05C 3/12; E05C 3/124; E05C 3/14; E05C 3/16; E05C 3/162; E05C 3/22; E05C 3/30
USPC ..... 68/3 R, 12.02, 12.26, 196; 292/95, 96, 292/98, 100–102, 108, 121, 124, 126, 128, 292/195, 197, 200, 202, 203, 210, 219, 220, 292/224, 226, 228, DIG. 11, DIG. 12, 292/DIG. 30, DIG. 36, DIG. 53, DIG. 64, 292/DIG. 69
See application file for complete search history.

(56) References Cited

U.S. PATENT DOCUMENTS 1,715,590 A * 6/1929 Burhenne ..... 292/228
3,918,751 A * 11/1975 Blake ..... 292/126
(Continued)

FOREIGN PATENT DOCUMENTS

DE 3827136 A1 * 3/1989
DE 3809998 A1 * 10/1989
(Continued)

OTHER PUBLICATIONS

Computer-Generated Translation for DE 3809998.*
(Continued)

*Primary Examiner* — Kristina Fulton
*Assistant Examiner* — Alyson M Merlino
(74) *Attorney, Agent, or Firm* — Staas & Halsey LLP

(57) ABSTRACT

A washing machine door, in which assembly efficiency of the door is improved, and an assembling structure and assembling method thereof are disclosed. The door includes a front panel forming the front surface of the door, a rear panel forming the rear surface of the door, a door handle mounted on the rear panel, fixing parts provided on the rear panel, a hook member operated in connection with the operation of the door handle, and an elastic member provided with one side fixed to the fixing parts and the other side fixed to the door handle to provide elastic force to the hook member and the door handle.

4 Claims, 8 Drawing Sheets

(56) References Cited

U.S. PATENT DOCUMENTS

| | | | | |
|---|---|---|---|---|
| 5,360,630 | A * | 11/1994 | Thomas et al. | 427/64 |
| 5,630,630 | A * | 5/1997 | Price et al. | 292/128 |
| 6,568,719 | B2 * | 5/2003 | Buscella | 292/85 |
| 7,269,981 | B2 * | 9/2007 | Kwon | 68/3 R |
| 7,552,951 | B2 * | 6/2009 | Kim | 292/113 |
| 7,644,963 | B2 * | 1/2010 | Fan et al. | 292/95 |
| 7,677,064 | B2 * | 3/2010 | Kim et al. | 68/196 |
| 8,016,328 | B2 * | 9/2011 | Sans Rovira et al. | 292/96 |
| 2004/0083769 | A1 * | 5/2004 | Kim et al. | 68/12.02 |
| 2004/0177656 | A1 | 9/2004 | Kwon | |
| 2004/0244435 | A1 * | 12/2004 | Kim | 68/12.26 |
| 2006/0006661 | A1 * | 1/2006 | Kim et al. | 292/29 |
| 2007/0290512 | A1 * | 12/2007 | Fan et al. | 292/95 |
| 2009/0096222 | A1 * | 4/2009 | Sans Rovira et al. | 292/216 |

FOREIGN PATENT DOCUMENTS

| | | | |
|---|---|---|---|
| EP | 1213415 | A1 * | 6/2002 |
| EP | 1486604 | A2 | 12/2004 |
| EP | 1741378 | A1 * | 1/2007 |
| KR | 10-2007-0037130 | | 4/2007 |
| WO | WO2008/086934 | A1 | 7/2008 |

OTHER PUBLICATIONS

Computer-Generated Translation for DE 3809998—Translation made on Oct. 1, 2013.*

European Search Report for corresponding European Patent Application No. 09167266.7 dated Mar. 9, 2010 (in English).

* cited by examiner

DOOR OF WASHING MACHINE AND ASSEMBLING STRUCTURE AND ASSEMBLING METHOD THEREOF

CROSS-REFERENCE TO RELATED APPLICATIONS

This application claims the benefit of Korean Patent Application No. 2008-0110754, filed on Nov. 10, 2008, in the Korean Intellectual Property Office, the disclosure of which is incorporated herein by reference.

BACKGROUND

1. Field

Embodiments of the present disclosure relate to a door, which opens and closes a main body of a washing machine, and an assembling structure and assembling method thereof.

2. Description of the Related Art

In general, washing machines are apparatuses, which remove dirt or contaminants from laundry through chemical decomposition and mechanical impact. Among these washing machines, a drum washing machine has an increased washing capacity as well as a reduced total height and scarcely generates problems, such as the entanglement of laundry, compared with a pulsator washing machine, in which an inner tub, i.e., a drum, is rotated while facing upward, thus being increasingly in great demand.

In such a drum washing machine, an opening, through which the laundry is put into the washing machine, is formed through the front surface of the main body, and a door to open and close the opening is rotatably installed at one side of the front surface of the main body.

The door includes a front panel and a rear panel forming the external appearance of the door, a door handle disposed between the front panel and the rear panel to allow a user to grip the door handle, and a door opening and closing device to open and close the door in connection with the operation of the door handle.

In the washing machine, when the user applies pressure to the door handle, the door opening and closing device is operated in connection with the door handle due to the application of pressure, and when the pressure applied to the door handle is released, the door handle and the door opening and closing device are returned to their original states.

In order to return the door handle and the door opening and closing device to their original states when the pressure applied to the door handle is released, as described above, the door opening and closing device includes an elastic member.

In a conventional assembling method of a door of a washing machine, the door is assembled by fixing one side of an elastic member to a door handle and fixing the other side of the elastic member to the rear surface of a front panel by pressure when the front panel is assembled with a rear panel.

However, the above conventional assembling method may cause mis-assembly between the elastic member and the front panel when the door is assembled, and when the elastic member and the front panel are mis-assembled, the door handle may move.

Further, an assembly time required to accurately assemble the front panel and the elastic member is increased, and thereby productivity of the washing machine is lowered and price competitiveness of the washing machine is deteriorated.

SUMMARY

Therefore, one aspect of the present disclosure is to provide a door of a washing machine, in which assembly efficiency of the door is improved, and an assembling structure and assembling method thereof.

Another aspect of the present disclosure is to provide a door of a washing machine, into which a front panel and a rear panel are assembled after a mounting position of an elastic member of a door opening and closing device is fixed, and an assembling structure and assembling method thereof.

In accordance with one aspect, the present disclosure provides a door of a washing machine including a front panel forming the front surface of the door; a rear panel forming the rear surface of the door; a door handle mounted on the rear panel; fixing parts provided on the rear panel; a hook member operated in connection with the operation of the door handle; and an elastic member provided with one side fixed to the fixing parts and the other side fixed to the door handle to provide elastic force to the hook member and the door handle.

The rear panel may include a holder member to receive the door handle; and the fixing parts may be provided on the holder member.

The holder member may be formed integrally with the rear panel.

The door may further include a pin member to connect the door handle and the hook member, and the rear panel may include support parts to support the pin member. The fixing parts may be respectively provided on the support parts.

In accordance with another aspect, the present disclosure provides an assembling structure of a door of a washing machine including a front panel forming the front surface of the door; a rear panel connected to the front panel and forming the rear surface of the door; a door handle rotatably disposed between the rear panel and the front panel; a hook member operated in connection with the operation of the door handle; and an elastic member to provide elastic force to the hook member and the door handle, wherein fixing parts to fix one side of the elastic member are provided on the rear panel; and the front panel and the rear panel are connected, after the elastic member is fixed to the fixing parts.

The rear panel may include a holder member to receive the door handle; and the fixing parts may be provided on the holder member.

In accordance with a further aspect, the present disclosure provides an assembling method of a door of a washing machine, which has a door handle, and a door opening and closing device to open and close the door in connection with the operation of the door handle, including mounting the door opening and closing device on a rear panel forming the rear surface of the door; fixing free terminals of an elastic member of the door opening and closing device to the rear panel; and connecting a front panel forming the front surface of the door to the rear panel.

The rear panel may include a holder member to receive the door handle; and in the fixation of the free terminals of the elastic member to the rear panel, the free terminals may be fixed to the holder member.

Additional aspects and/or advantages will be set forth in part in the description which follows and, in part, will be apparent from the description, or may be learned by practice of the embodiments.

BRIEF DESCRIPTION OF THE DRAWINGS

These and/or other aspects of the disclosure will become apparent and more readily appreciated from the following description of the embodiments, taken in conjunction with the accompanying drawings in which.

DETAILED DESCRIPTION

Figure 1:
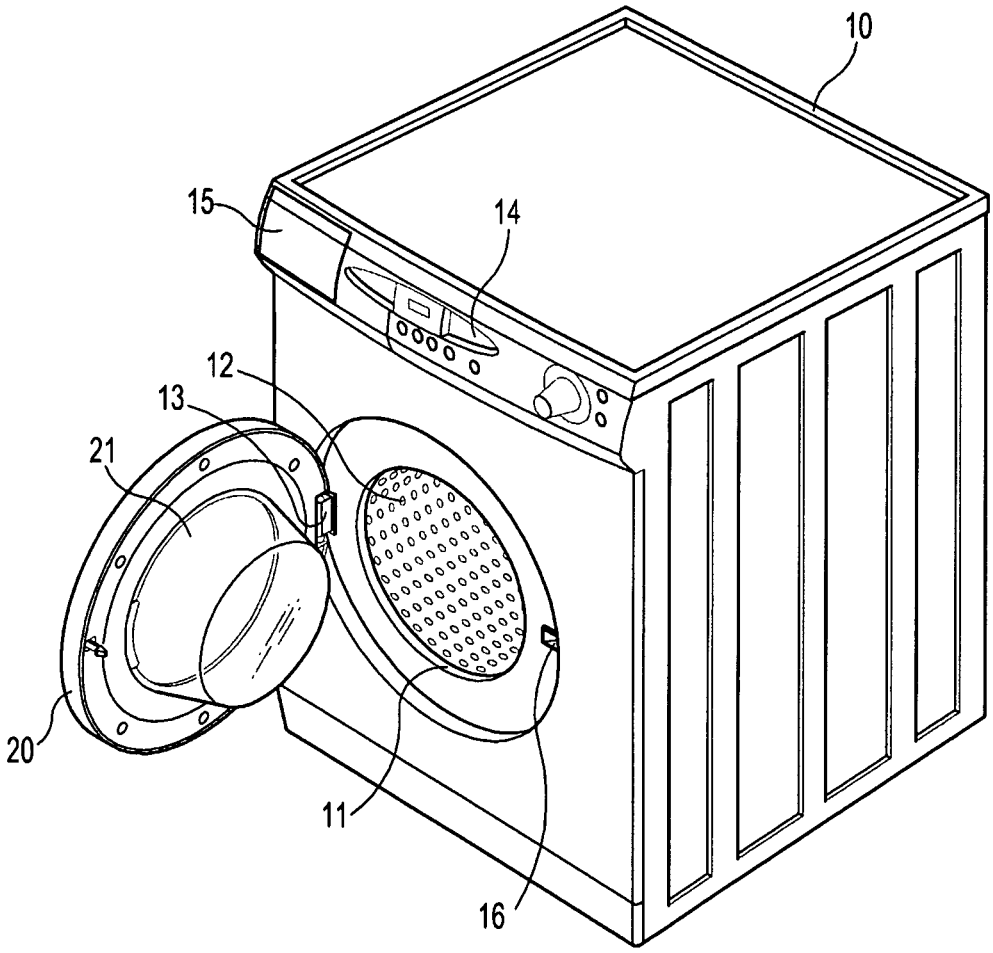
FIG. 1 is a perspective view illustrating a washing machine in accordance with one embodiment of the present disclosure in a state in which a door is opened.

Reference will now be made in detail to embodiments of the present disclosure, examples of which are illustrated in the accompanying drawings, wherein like reference numerals refer to like elements throughout.

Hereinafter, with reference to the accompanying drawings, a door of a washing machine in accordance with one embodiment of the present disclosure and an assembling structure and assembling method thereof will be described.

Figure 2:
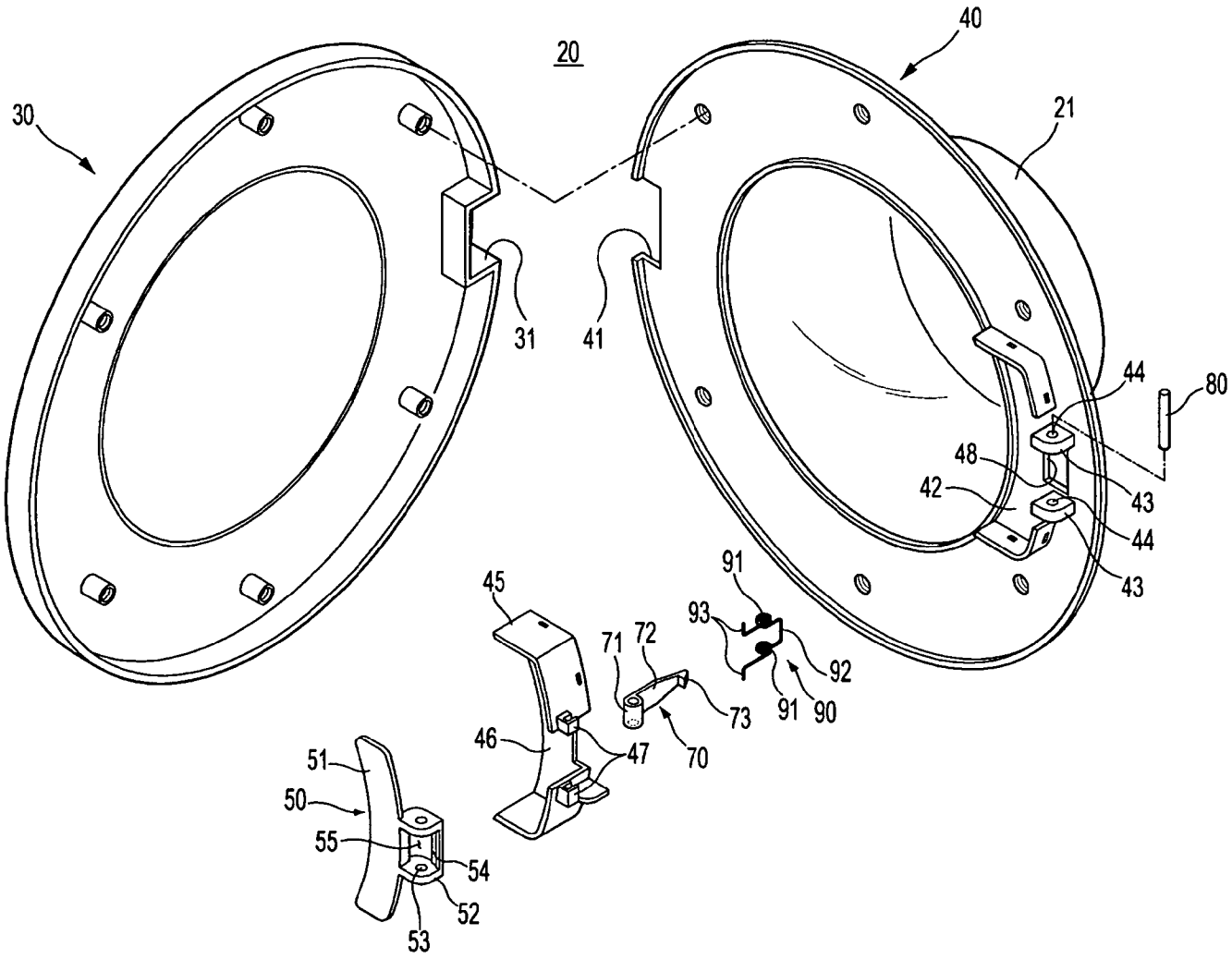
FIG. 2 is an exploded perspective view of the door of the washing machine in accordance with the embodiment of the present disclosure.

FIG. 1 is a perspective view illustrating the washing machine in accordance with one embodiment of the present disclosure in a state in which the door is opened, and FIG. 2 is an exploded perspective view of the door of the washing machine in accordance with the embodiment of the present disclosure.

Figure 3:
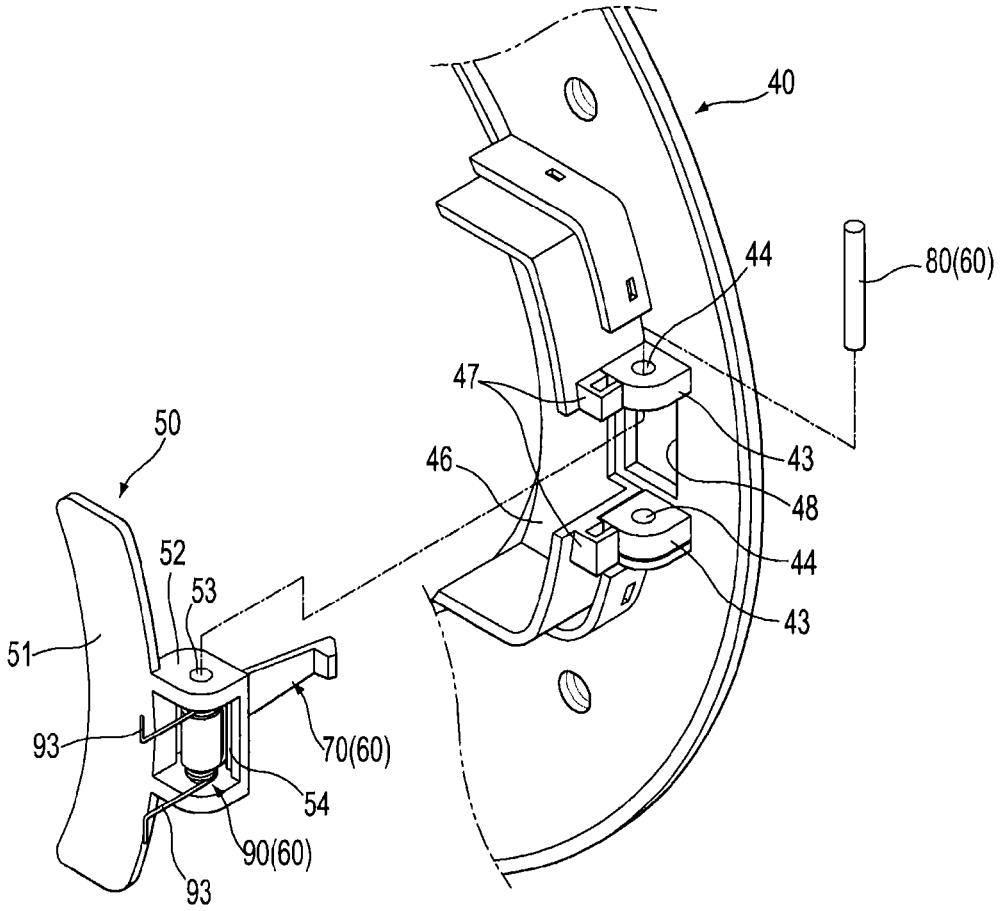
FIGS. 3 and 4 are views illustrating a process of assembling a door handle and a door opening and closing device of the door in accordance with the embodiment of the present disclosure.
Figure 4:
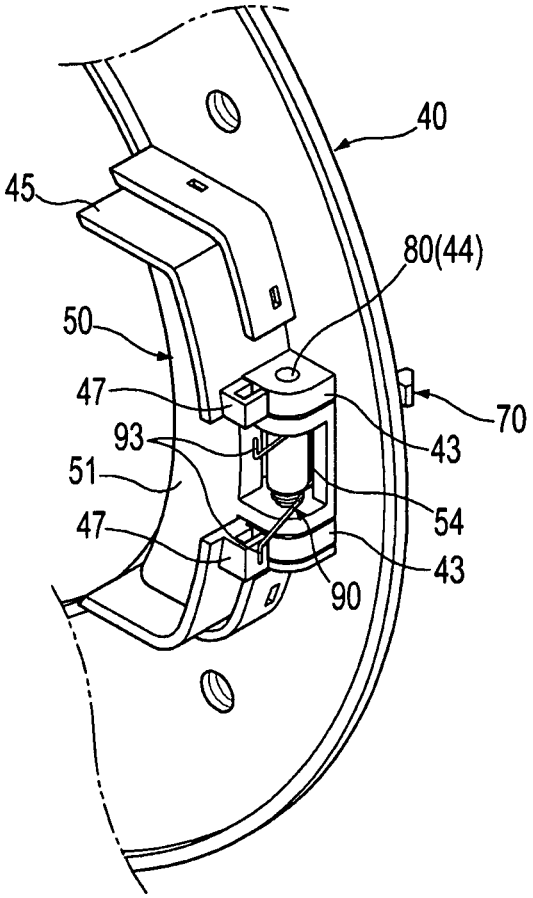
Figure 5:
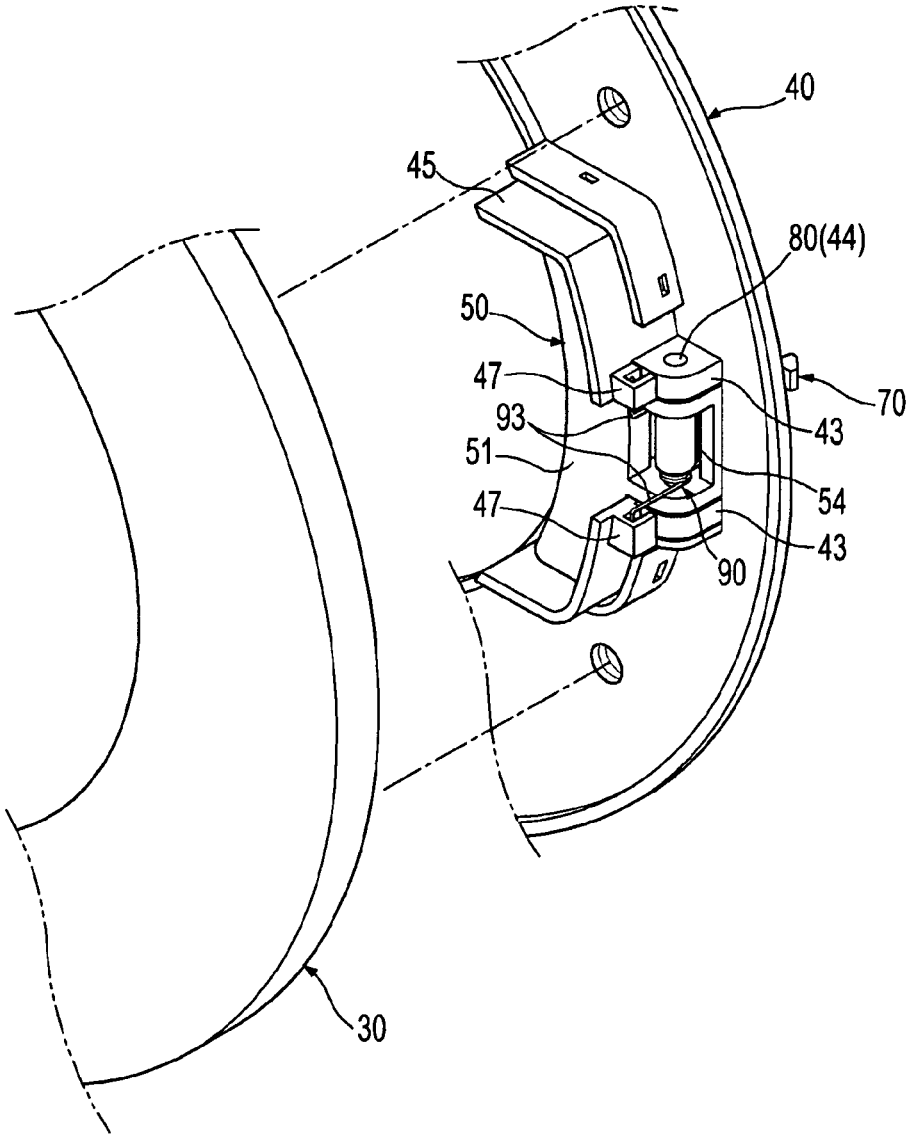
FIG. 5 is a view illustrating an assembling operation of a front panel of the door of the washing machine in accordance with the embodiment of the present disclosure.

FIGS. 3 and 4 are views illustrating a process of assembling a door handle and a door opening and closing device of the door in accordance with the embodiment of the present disclosure, and FIG. 5 is a view illustrating an assembling operation of a front panel of the door of the washing machine in accordance with the embodiment of the present disclosure.

The washing machine in accordance with the present disclosure, as shown in FIG. 1, may include, for example, a main body 10 having an approximately box shape and provided with an opening 11 formed through the front surface of the main body 10 such that laundry is put into or taken out of the main body 10 through the opening 11, a tub (not shown) and a drum 12 installed in the main body 10 in the horizontal direction, and a door 20 to open and close the opening 11 of the main body 10.

The door 20 is rotatably connected to the main body 10 by a hinge member 13 installed at one side end of the door 20.

When the operation of the washing machine is stopped or completed, a user opens the door 20 so that laundry may be put into or taken out of the main body 10, and when the washing machine is operated, the user closes the door 20 such that washing of the laundry is carried out in the closed state of the opening 11.

A control panel 14 to control the washing machine is provided on the upper portion of the front surface of the main body 10, and a detergent box 15 is installed at one side of the control panel 14.

Further, a hook coupling part 16 having a designated size, which connects with or separates from a hook member 70 of a door opening and closing device 60, which will be described later, to or from the main body 10, is formed on the main body 10.

The door 20, as shown in FIGS. 2 to 5, includes a front panel 30 forming the external appearance of the front surface of the door 20, a rear panel 40 connected with the front panel 30, a door handle 50 provided at the other side end of the door 20 opposite from the hinge member 13 to facilitate the opening and closing of the door 20, and the door opening and closing device 60 (not shown) to lock the door 20 with the main body 10 and release the locking of the door 20 with the main body 10 in connection with the operation of the door handle 50.

The front panel 30 is formed in a ring shape, the central portion of which is open to form an orifice. A first hinge coupling part 31 is provided at one side end of the front panel 30 to connect the hinge member 13 to the door 20.

The shape of the rear panel 40 corresponds to the shape of the front panel 30 and forms the external appearance of the rear surface of the door 20. A second hinge coupling part 41 corresponds to the first hinge coupling part 31 to connect the hinge member 13 to the door 20. The second hinge coupling part 41 is provided at one side end of the rear panel 40, and a mounting part 42 is provided at the other side end of the rear panel 40 opposite the second hinge coupling part 41. The mounting part 42 is provided for mounting of door handle 50.

A pair of support parts 43 to rotatably support the door handle 50 is provided on the mounting part 42, and a first pin hole 44, into which a pin member 80 is inserted, is formed through each of the support parts 43. The pin member 80 will be described in greater detail below.

The door handle 50 is provided between the front panel 30 and the rear panel 40 such that a user may easily grip the door handle 50 and apply pressure to the door handle 50.

The door handle 50 includes a grip part 51 to allow the user to grip the door handle 50, and a coupling part 52 extended from the grip part 51 to rotatably mount the door handle 50 on the rear panel 40.

The grip part 51 has a curved plate shape, which is elongated approximately in the lengthwise direction, so as not to be exposed from the inner circumferential surface of the door 20.

The coupling part 52 is extended outward from the center of the grip part 51, and a pair of second pin holes 53, into which the pin member 80 is inserted, is formed at a position of the coupling part 52 corresponding to the first pin holes 44 of the support parts 43.

Therefore, the door handle 50 is connected to the rear panel 40 so that the door handle 50 is rotated forward and backward, by disposing the coupling part 52 between the pair of the support parts 43 of the rear panel 40 while communicating the first and second pin holes 44 and 53 with each other and then inserting the pin member 80 into the first and second pin holes 44 and 53.

A first fixing part 54, to fix a connection part 92 of an elastic member 90, which will be described later, is formed on the coupling part 52. A reception part 55, to receive a rotational center part 71 of a hook member 70, which will be described later, is formed between the pair of the second pin holes 53 formed at both sides of the coupling part 52.

The door 20 further includes a transparent member 21 connected to the inner circumferential surface of the rear panel 20 such that the inside of the drum 12 is seen from the outside. Here, the rear panel 40 further includes a holder member 45 to mount the transparent member 21 on the rear panel 40.

Figure 8:
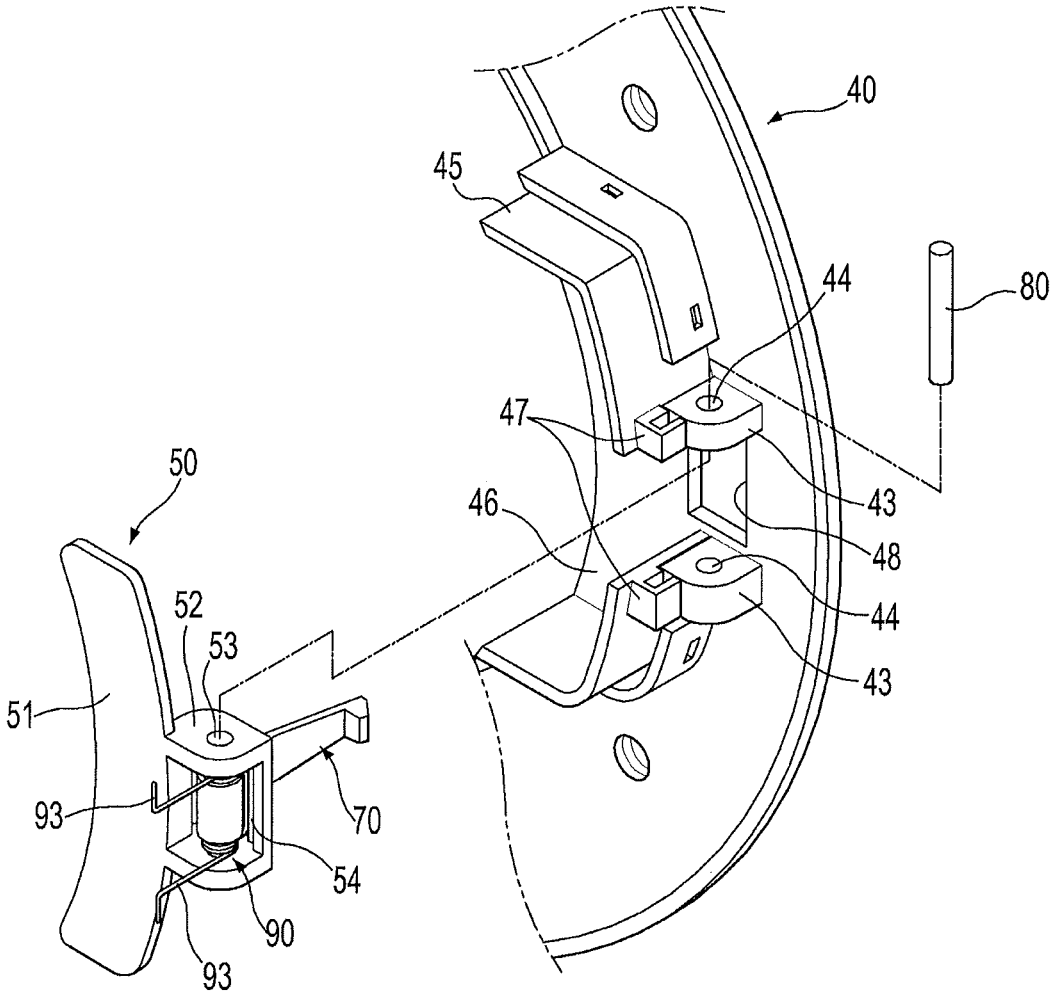
FIG. 8 is a view illustrating a process of assembling a door handle and a door opening, and closing device of the door including a holder member formed integrally with the rear panel of the door in accordance with the embodiment of the present disclosure.

The holder member 45 may be formed integrally, e.g., of one-piece construction with the rear panel 40, as shown in the embodiment illustrated in FIG. 8. Alternatively, in the embodiment illustrated in FIGS. 3 and 4, the holder member 45 is formed separately from the rear panel 40 and thus the rear panel 40 further includes the holder member 45 detachably mounted on the rear panel 40.

The holder member 45 is mounted on the rear panel 40 through hook coupling, and one side of the edge of the transparent member 21 is inserted into a separation space between the holder member 45 and the rear panel 40.

Further, a handle reception part 46, in which the door handle 50 is mounted, is formed on the holder member 45, and the door handle 50 is mounted on the rear panel 40 within the handle reception part 46 such that the door handle 50 is rotated forward and backward.

The door opening and closing device 60 includes the hook member 70 operated in connection with the operation of the door handle 50, the pin member 80 to rotatably mount the hook member 70 and the door handle 50 on the rear panel 40, and the elastic member 90 to return the hook member 70 and the door handle 50 to their original positions when the force applied to the door handle 50 is removed.

The hook member 70 includes the rotational center part 71 connected with the pin member 80, a lever part 72 protruding from one side of the rotational center part 71 to receive the rotary force of the door handle 50, and a hook part 73 formed at the front end of the lever part 72 to lock the door 20 with the main body 10.

A lever hole 48 having a designated size, through which the lever part 72 may be protruded to the outside of the rear panel 40, is formed through the rear panel 40.

Further, the hook coupling part 16, into which the hook part 73 may be inserted, is formed on the main body 10 at a position corresponding to the hook part 73.

The elastic member 90, which returns the door handle 50 and the hook member 70 to their original positions when the force applied to the grip part 51 by a user is removed, is provided on the pin member 80 to connect the door handle 50 and the rear panel 40.

The elastic member 90 may include a variety of springs, such as a torsional spring, to which a torsional stress in the rotational direction to the axis line is applied. This embodiment exemplarily describes a double torsional spring with two symmetrical terminals.

The elastic member 90 includes a pair of coil parts 91, a connection part 92 formed at the inner parts of the coil parts 91 to connect the coil parts 91, and a pair of free terminals 93 formed at the outer ends of the coil parts 91 and protruding from the coil parts 91.

The pair of the coil parts 91 is formed such that the pin member 80 is inserted into the coil parts 91, and the connection part 92 connecting the coil parts 91 is inserted into the first fixing part 54 of the door handle 50, and the free terminals 93 are fixed to the holder member 45.

Second fixing parts 47 to fix the pair of the free terminals 93 of the elastic member 90 are provided on the holder member 45. The second fixing parts 47 are formed in a pair corresponding to the pair of the free terminals 93, and thus the free terminals 93 are respectively fixed to the corresponding second fixing parts 47.

After the free terminals 93 of the elastic member 90 are fixed to the second fixing parts 47, as described above, the front panel 30 is assembled with the rear panel 40.

Therefore, in this embodiment, both sides of the elastic member 90 are fixed prior to the assembly of the front panel 30 and the rear panel 40, and then the front panel 30 is assembled with the rear panel 40, thereby preventing misassembly between the elastic member 90 and the front panel 30 and shortening an assembly time, compared with the conventional method that one end of an elastic member is fixed to the rear surface of a front panel by pressure when the front panel is assembled with a rear panel, and thus being capable of improving productivity and reducing production costs.

Hereinafter, an assembling method of the door of the washing machine in accordance with this embodiment will be described with reference to the accompanying drawings.

As shown in FIGS. 2 and 3, the transparent member 21 is fixed to the rear panel 40, and then the holder member 45 is mounted on the rear panel 40.

Alternately, the holder member 45 may be mounted on the rear panel 40, and then the transparent member 21 may be interposed between the rear panel 40 and the holder member 45.

Thereafter, as shown in FIGS. 3 and 4, the connection part 92 of the elastic member 90 is fixed to the first fixing part 54 of the door handle 50, and the rotational center part 71 of the hook member 70 is located in a space between the pair of the coil parts 91 of the elastic member 90 so that the second pin holes 53 of the coupling part 52 of the door handle 50, the coil parts 91 of the elastic member 90, and the rotational center part 71 of the hook member 70 are communicated with one another.

Thereafter, the pin member 80 is inserted into the first pin holes 44 of the support parts 43 so that the pin member 80 passes through the second pin holes 53, the coil parts 91, and the rotational center part 71, communicated with the first pin holes 44, thereby rotatably connecting the door handle 50 and the hook member 70 between the support parts 43 of the rear panel 40.

Thereafter, as shown in FIGS. 4 and 5, the free terminals 93 at the other end of the elastic member 90 are fixed to the second fixing parts 47 of the holder member 45 by pressure, thereby completing the mounting of the elastic member 90 on the rear panel 40.

Thereafter, the front panel 30 is connected to the front surface of the rear panel 40 provided with the above-described various parts mounted thereon, thereby completing the assembly of the door.

Hereinafter, a door of a washing machine in accordance with another embodiment of the present disclosure and an assembling structure and assembling method thereof will be described.

Figure 6:
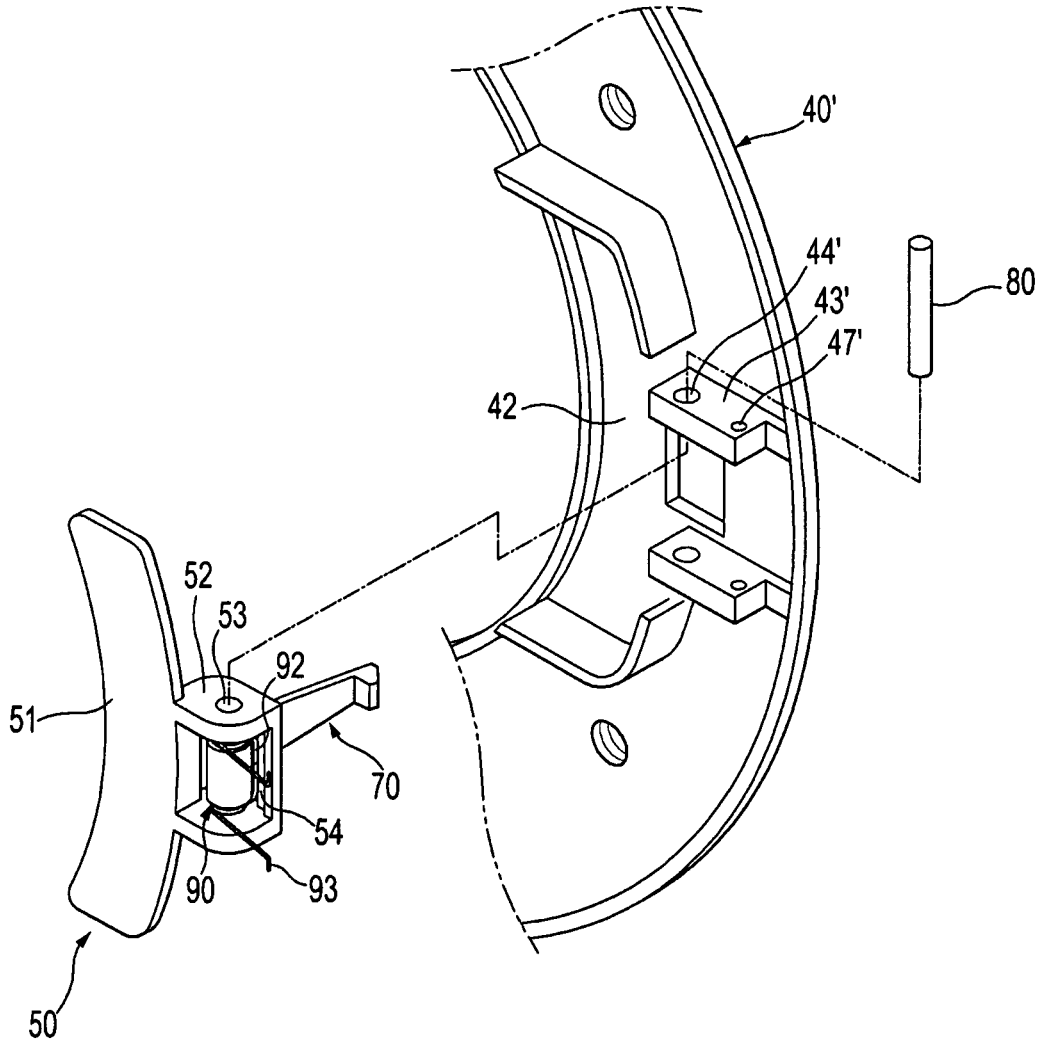
FIG. 6 is a view illustrating an assembling operation of a door handle and a door opening and closing device of a door of a washing machine in accordance with another embodiment of the present disclosure.
Figure 7:
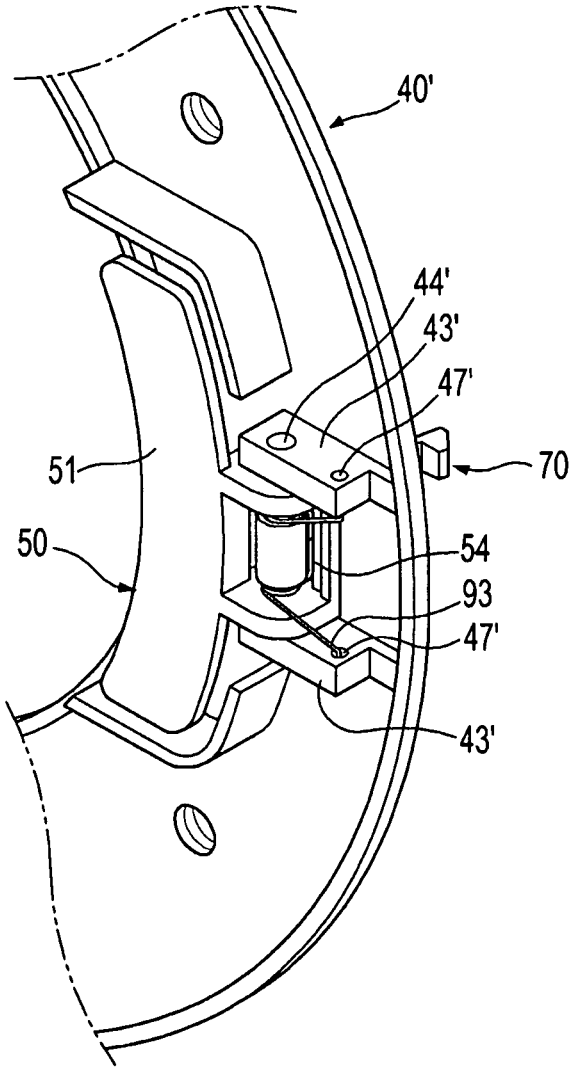
FIG. 7 is an assembled perspective view of an essential portion of the door in accordance with the embodiment of the present disclosure.

FIG. 6 is a view illustrating an assembling operation of a door handle and a door opening and closing device of the door of the washing machine in accordance with another embodiment of the present disclosure, and FIG. 7 is an assembled perspective view of an essential portion of the door in accordance with the embodiment of the present disclosure.

The following embodiment may have the same configuration as that of the former embodiment except for the structure of a rear panel.

Hereinafter, elements in this embodiment, which may be substantially the same as those in the former embodiment, are denoted by the same reference numerals even though they are depicted in different drawings, and a detailed description thereof will thus be omitted. Therefore, only those elements in the following embodiment that are different from those in the former embodiment will be described.

The door 20 in accordance with this embodiment, as shown in FIG. 6, includes a front panel 30 forming the external appearance of the front surface of the door 20, a rear panel 40' connected with the front panel 30, a door handle 50 provided at the other side end of the door 20 opposite to a hinge member 13 of the door 20 to facilitate the opening and closing of the door 20, and a door opening and closing device 60 to lock the door 20 with the main body 10 and release the locking of the door 20 with the main body 10 in connection with the operation of the door handle 50.

A mounting part 42 to mount the door handle 50 is provided on the rear panel 40'.

A pair of support parts 43' to rotatably support the door handle 50 is provided on the mounting part 42, and a first pin hole 44', into which a pin member 80 is inserted, is formed through each of the support parts 43'.

The door opening and closing device 60 includes a hook member 70 operated in connection with the operation of the door handle 50, the pin member 80 to rotatably mount the hook member 70 and the door handle 50 on the rear panel 40, and an elastic member 90 to return the hook member 70 and the door handle 50 to their original positions when the force applied to the door handle 50 is removed.

A connection part 92 of the elastic member 90 is fixed to a first fixing part 54 of the door handle 50 in the same manner as the former embodiment.

Free terminals 93 of the elastic member 90 are fixed to the rear panel 40'. Second fixing parts 47', which are respectively formed integrally with the support parts 43' to fix the free terminals 93, are formed on the rear panel 40, and the free terminals 93 of the elastic member 90 are fixed to the second fixing parts 47'.

Here, although this embodiment illustrates that the support parts 43' and the second fixing parts 47' are formed integrally, second fixing parts may be respectively provided on the rear panel 40' at positions separated from the support parts 43'.

Although the second fixing parts 47' are illustrated as formed in the shape of a hole, the second fixing parts 47' may alternatively be formed in a loop or clasp shape, in the same manner as the former embodiment.

Further, although this embodiment omits a holder member, the holder member may be provided in the same manner as the former embodiment.

After the free terminals 93 of the elastic member 90 are fixed to the second fixing parts 47', as described above, the front panel 30 is assembled with the rear panel 40.

Therefore, in this embodiment, both sides of the elastic member 90 are fixed prior to the assembly of the front panel 30 and the rear panel 40, and then the front panel 30 is assembled with the rear panel 40, thereby preventing misassembly between the elastic member 90 and the front panel 30 and shortening an assembly time, compared with the conventional method that one end of an elastic member is fixed to the rear surface of a front panel by pressure when the front panel is assembled with a rear panel, and thus being capable of improving productivity and reducing production costs.

As is apparent from the above description, in the door of the washing machine and the assembling structure and assembling method thereof in accordance with the present disclosure, the elastic member of the door opening and closing device is fixed prior to the assembly of the front panel and the rear panel, and thus the assembly efficiency of the door is improved.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. An assembling structure of a door of a washing machine comprising:

a front panel forming a front surface of the door;

a rear panel connected to the front panel and forming a rear surface of the door;

a holder member mounted on the rear panel to receive the door handle and comprising second fixing parts;

a door handle rotatably disposed between the rear panel and the front panel;

a hook member operated in connection with an operation of the door handle; and an elastic member to provide an elastic force to the hook member and the door handle, the elastic member comprising a pair of coil parts separated by a connection part formed at an inner portion of the coil parts and connecting the coil parts, and a pair of symmetrical free terminals each formed at an outer portion of one of the coil parts, wherein the connection part is fixed to a first fixing part of the door handle such that the connection part makes contact with the first fixing part to apply the elastic force to the door handle and wherein the second fixing parts are each formed as clasps on the holder member for securing each of the free terminals, which are inserted into each of the second fixing parts, wherein the door handle, the hook member and the elastic member are mounted on the rear panel and, wherein the front panel and the rear panel are connected after the elastic member is fixed to the first fixing part.

2. The assembling structure according to claim 1, wherein the second fixing parts are provided on the holder member.

3. A washing machine door having a front panel, a rear panel, and a door handle mounted on the rear panel, the washing machine door comprising:

a first fixing part provided on the door handle;

a holder member mounted on the rear panel and comprising second fixing parts;

a hook member operated in connection with an operation of the door handle; and an elastic member comprising a pair of coil parts separated by a connection part formed at an inner portion of the coil parts and connecting the coil parts, and a pair of symmetrical free terminals each formed at an outer portion of one of the coil parts, wherein the connection part is fixed to the first fixing part provided on the door handle such that the connection part of the elastic member makes contact with the first fixing part to apply an elastic force to the door handle and wherein the second fixing parts are each formed as clasps on the holder member for securing each of the free terminals, which are inserted into each of the second fixing parts.

4. The washing machine door according to claim 3, further comprising:

support parts included in the rear panel to support the door handle;

a coupling part formed in the door handle; and a pin member to rotatably connect the door handle and the hook member by passing through each of the coupling part, a rotational center part of the hook member, the support parts and each coil part of the pair of coil parts.

* * * * *